United States Patent [19]

Baggio et al.

[11] Patent Number: 4,727,627

[45] Date of Patent: Mar. 1, 1988

[54] LOCKING DEVICE PARTICULARLY FOR SKI BOOTS

[75] Inventors: Giorgio Baggio, S. Martino Di Lupari; Giuseppe De Bortoli, Montebelluna, both of Italy

[73] Assignee: Nordica S.p.A., Montebelluna TV, Italy

[21] Appl. No.: 9,169

[22] Filed: Jan. 30, 1987

[30] Foreign Application Priority Data

Feb. 6, 1986 [IT] Italy ..... 20872/86[U]

[51] Int. Cl.[4] ..... A43B 11/00; A43C 11/00

[52] U.S. Cl. ..... 24/68 SK; 24/71 SK; 36/50

[58] Field of Search ..... 24/68 SK, 69 SK, 71 R, 24/71 A, 498, 71 SK; 36/50, 117

[56] References Cited

U.S. PATENT DOCUMENTS 4,193,171 3/1980 Lichowsky ..... 24/68 SK
4,199,182 4/1980 Sunesson ..... 24/68 CD
4,530,135 7/1985 Hsiang ..... 24/68 CD
4,547,980 10/1985 Olivieri ..... 36/50
4,616,524 10/1986 Bidoia ..... 36/50
4,619,057 10/1986 Sartor et al. ..... 24/68 SK
4,633,599 1/1987 Morell et al. ..... 24/68 SK

FOREIGN PATENT DOCUMENTS 3013953 10/1981 Fed. Rep. of Germany ... 24/69 SK

*Primary Examiner*—Victor N. Sakran
*Attorney, Agent, or Firm*—Guido Modiano; Albert Josif

[57] ABSTRACT

The locking device comprises an operating lever, pivotally connected to one of the elements to be brought together, and supporting a take-up spool for a joining element, connected at a fixed point to the other of the elements to be brought together. The spool is rotatable about an axis spaced from and lying substantially parallel to the pivot axis of the lever. There are also provided members for releasably blocking rotation of the spool at least in the direction of unwinding of the joining element.

6 Claims, 5 Drawing Figures

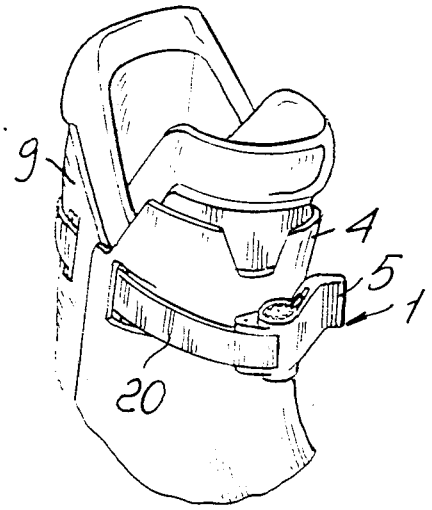
Fig. 1
Fig. 4
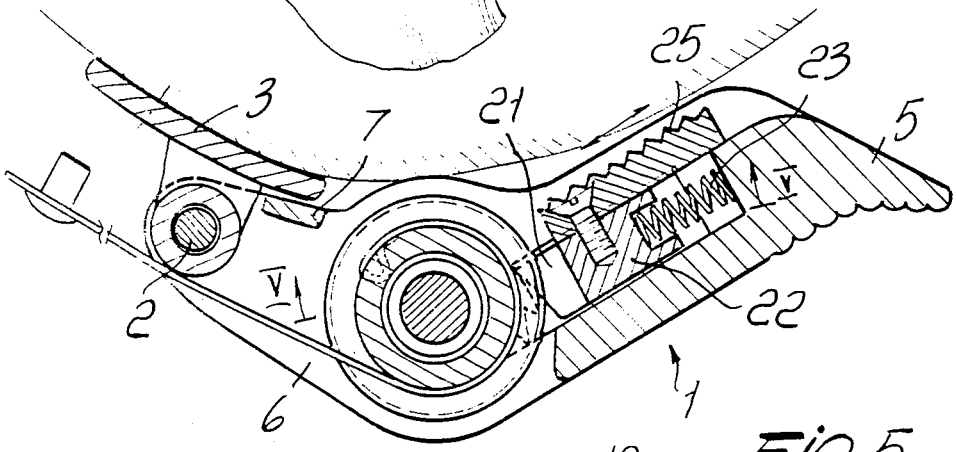
Fig. 5
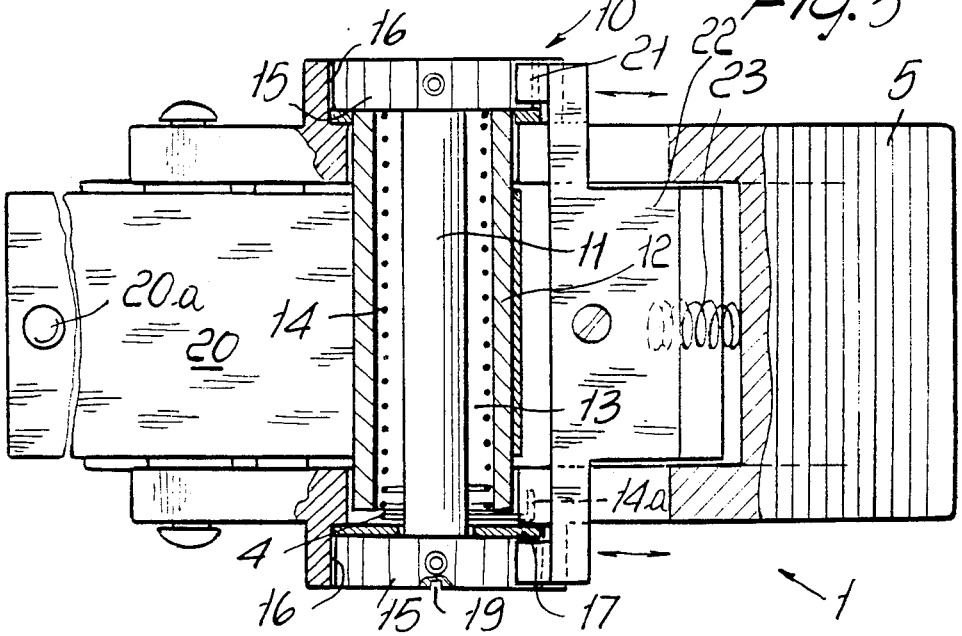

LOCKING DEVICE PARTICULARLY FOR SKI BOOTS

BACKGROUND OF THE INVENTION

The present invention relates to a locking device particularly for ski boots.

As is known, ski boots are currently provided with locking devices, used e.g. to close the boot, which are composed of a lever with a dentellated band which couples with a dentelated block, or are composed of a lever with a flexible cable having a hook which couples with a drilled plate or, eventually, with a lever with a ring which inserts into a dentellated block.

In all the known embodiments, in which the lever and the elements connected thereto are used to bring together two separate parts of a boot, all the component elements may be easily disassembled and when closing it is necessary for the user to bring back together the elements which separate when opening, with some difficulty, taking into account the environmental conditions in which such actuations must be effected.

Another disadvantage resides in the fact that the elements which separate may give rise, through blows or for other reasons, to the accidental loss of a part of the same components, with the obvious associated drawbacks.

SUMMARY OF THE INVENTION

The aim proposed by the invention is indeed to eliminate the above described disadvantages by providing a locking device studied specifically for ski boots, in which there is no separation of the component elements even when opening, furthermore facilitating the operation of the device itself.

Within the scope of the above described aim, a particular object of the invention is to provide a locking device in which the step of mutually moving closer the parts to be brought together can be achieved in an essentially automatic manner, without the need to exert effort on the part of the user, with the possibility of performing, by means of a lever, the final locking.

Still another object of the present invention is to provide a locking device particularly for ski boots which can be obtained with a limited number of component elements, and which, for its peculiar structural characteristics, is capable of offering the greatest assurances of reliability and safety in use.

The above described aim, as well as the objects mentioned and others which will become apparent hereinafter, are achieved by a locking device particularly for ski boots, according to the invention, characterized in that it comprises an operating lever pivoted to one of the elements to be brought together and supporting a take-up spool for a joining element connected at a fixed point to the other one of the elements to be brought together, said spool being rotatable about an axis which is spaced from and substantially parallel to the pivot axis of said lever, there also being provided means for releasably blocking movement of said take-up spool at least in the direction of unwinding of said joining element.

BRIEF DESCRIPTION OF THE DRAWINGS

Further characteristics and advantages will become apparent from the detailed description of a locking device particularly for ski boots, illustrated only by way of non-limitative example in the accompanying drawings, wherein:

FIG. 1 is a schematic perspective view of the locking device used to close the quarters of a ski boot;

FIG. 4 is a cross section view of the device in a closed position, taken along a plane extending perpendicular to the pivot axis of the operating lever.

FIG. 5 is a cut-away, front, cross section, view of the device along the line V—V of FIG. 4.

DESCRIPTION OF THE PREFERRED EMBODIMENTS

Figure 2:
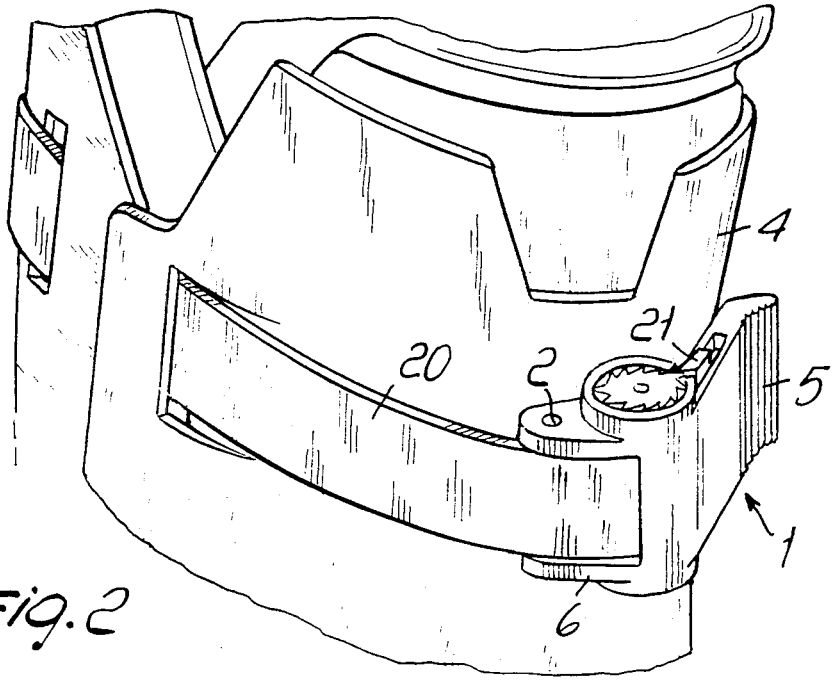
FIG. 2 is a perspective view of the device in a closed position.
Figure 3:
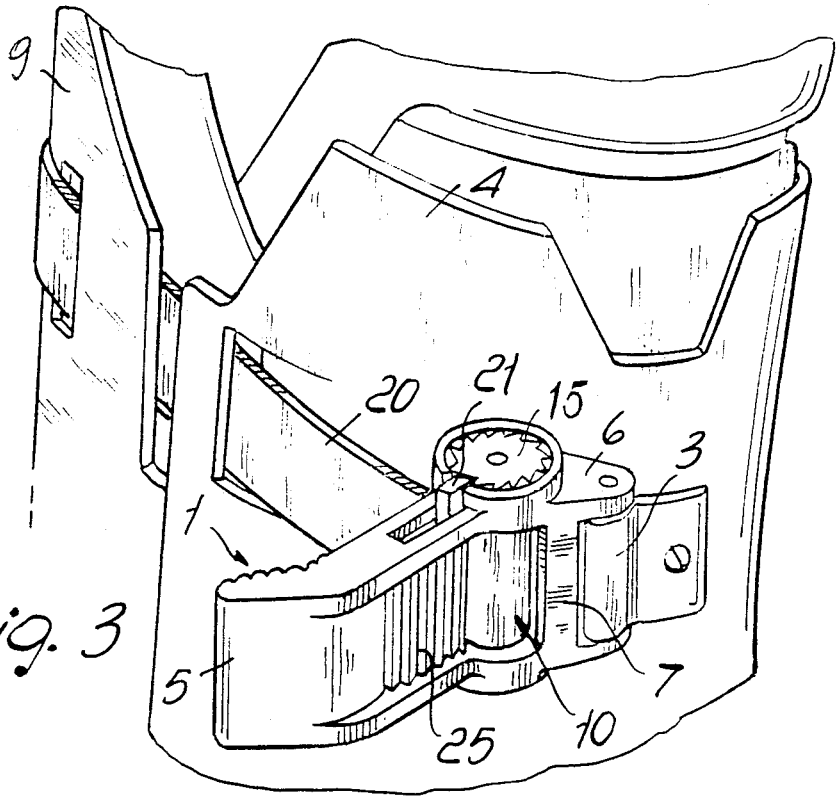
FIG. 3 is a perspective view of the device with the lever in an open position.

With reference to the above described figures, the locking device, particularly for ski boots, according to the invention, in the accompanying drawings, by way of example, is applied to perform the closure of the quarters of a ski boot.

The locking device according to the invention may also have other applications, such as the securing of the heel, the securing of the foot instep, and so on.

The device comprises an operating lever, generally indicated with the reference numeral 1, which is pivoted, at one end thereof, to a pivot 2 which, in the example described, extends substantially parallel to the longitudinal extension of the quarters of the boot.

The pivot 2 is connected to a small base 3 which is fixed to one of the elements to be brought together, composed e.g. of the rear quarter 4.

The operating lever 1, in its embodiment, is provided with a grip tab 5, on the opposite part with respect to the leverage pivot 2, and is provided with lateral arms 6 which engage with the pivot 2 and are joined by a reinforcing crosspiece 7.

At a middle portion thereof, the operating lever 1 rotatably supports a take-up spool, generally indicated with the reference numberal 10, which is rotatable about an axis spaced from the pivoting axis of the lever 1, composed of the pivot 2.

An important peculiarity of the invention resides in the fact that the take-up spool 10 is of the automaticrewind type.

For this purpose, the take-up spool is provided with a central shaft 11 which is surrounded by a cylindrical drum 12 spaced from the shaft 11 and rotatably supported by the lever 1; in the interspace 13 defined between the shaft 11 and the drum 12 a spring of the torsion type 14 is accommodated, which has one end fixed to the drum itself and the other end, indicated with the reference numeral **14*a*, connected to the body of the lever 1**.

Furthermore, the shaft 11 is rigidly coupled, at its axial ends, with toothed wheels 15 which are rotatably accommodated in recesses 16 defined by the body of the lever.

Friction disks 17, which act between the toothed wheels 15 and the body of the lever 1, are interposed below the toothed wheels 15.

Furthermore, on one of the toothed wheels a slot for a screwdriver 19 is provided which allows one to perform the initial loading of the spring, which, as will be better described hereinafter, allows obtainment of the automatic rewinding of the spool.

A joining element is connected to the spool and is advantageously composed of a flexible band 20 which has a fixed point, schematically indicated with the reference numeral 20*a*, on the other of the elements to be brought together, which, in the example illustrated, is represented by the front quarter 9.

With the toothed wheels 15 engage means for releasably locking rotation of the spool constituted by locking teeth 21 which are connected to a slider 22, pushed by a pusher spring 23 and slideably accommodated in the lever body 1 to keep the teeth 21 engaged with the toothed wheels 15, preventing the rotation of the take-up spool 10.

The slider is slideable by means of a key 25 which is accessible on the inner face of the lever, i.e. on the face of the lever which is arranged against the boot in closed position in order to achieve motion of the slider and the consequent uncoupling of the teeth 21 from the toothed wheels 15, thus allowing the rotation of the spool.

In practical use, before connecting the band 20 to the spool, the torsion spring 14 is pre-loaded.

By pre-loading the torsion spring 14, the band tends to wind automatically onto the spool until the traction force compensates the elastic return force.

In order to close the boot, first the teeth 21 are uncoupled from the toothed wheels 15, so that the spool rewinds the desired amount of band.

Once this initial rewinding has taken place, the locking is achieved by using the operating lever which is provided with a constant arm, so as to exert the required locking force.

In order to open the device, naturally one proceeds in reverse, i.e. first the operating lever is opened, thus reducing, at least partially, the force exerted, then one acts on the slider, uncoupling the teeth 21 from the toothed wheels 15, and the unwinding of the required amount of band can be achieved by overcoming the elastic biasing action exerted by the spring 14 until the desired opening is obtained.

From what has been described, it can be seen that the invention achieves the intended aim and objects, and in particular the fact is stressed that once the correct adjustment of the useful band has been set, by opening the operating lever one achieves a partial slackening of the locking action, without however altering the useful length of the band, so that by closing the lever again one achieves the preset locking.

Furthermore, the use of a band, rather than rigid elements, affords the great advantage of being easily adaptable to any configuration and deformation of the boot.

In practice, the materials employed, so long as compatible with the specific use, as well as the dimensions and the contingent shapes, may be any according to the requirements.

We claim:

1. Locking device, particularly for ski boots having two elements articulated to each other and adapted to be brought together, comprising a joining element, a preloadable torsion spring having an axis, an operating lever having a middle portion, at least one end and at least one other end, said at least one end having rigidly associated therewith at least one grip tab, said opposite end being pivotally attached to one of said two elements to be brought together at a pivot axis, said device further comprising a take-up spool, said take-up spool being internally housed in said lever substantially at said middle portion thereof, said joining element being attached to another of said two elements adapted to be brought together, said axis of said preloadable torsion spring being substantially parallel to said pivot axis, said preloadable torsion spring being accomodated internally at said spool and adapted for automatically rewinding said joining element around said spool, said spool being rotatable about a spool axis, said spool axis coinciding with said axis of said preloadable torsion spring, said lever and said take-up spool being ratatable about said pivot axis, said pivot axis being substantially spaced from said spool axis.

2. Locking device, according to claim 1 wherein said spool comprises a central shaft and a cylindrical drum, said central shaft being surrounded by said cylindrical drum, said cylindrical drum being rotatably supported by said lever, between said shaft and said drum there being defined an interspace, said spring being accomodated in said interspace.

3. Locking device, according to claim 2 wherein said spring has at least one end and at least one other end, said at least one end of said spring being connected to said central shaft, said at least one other end of said spring being connected to said lever.

4. Locking device, according to claim 2 wherein said lever has formed therein a plurality of recesses and wherein said shaft has at its axial ends toothed wheels, said toothed wheels being rotatably accomodated in said plurality of recesses formed in said lever, at least one of said wheels having formed therein a screwdriver slot, said screwdriver slot being adapted for permitting initial loading of said spring, for causing automatic rewinding of said spool.

5. Locking device, according to claim 4 wherein said takeup spool comprises locking teeth, said locking teeth being attached to a slider, said slider being accomodated in said grip tab and adapted to be pushed by a pusher spring, said pusher spring being adapted to keep said locking teeth engaged with said toothed wheels for preventing rotation of said spool.

6. Locking device, according to claim 4 wherein said take-up spool comprises locking teeth, said locking teeth being attached to a slider, said slider being accomodated in said grip tab and adapted to be pushed by a pusher spring, said pusher spring being adapted to keep said locking teeth engaged with said toothed wheels for preventing rotation of said spool, said locking device further comprising an operating button said lever having an inner face, said operating button being connected to said slider at said inner face of said lever said inner face of said lever being adapted to be placed in a closed position in contact with a ski boot.

* * * * *